US009807508B2

(12) United States Patent
Guo et al.

(10) Patent No.: US 9,807,508 B2
(45) Date of Patent: Oct. 31, 2017

(54) LONG STROKE SPEAKER

(71) Applicants: Shun Guo, Shenzhen (CN); Lubin Mao, Shenzhen (CN); Hongxing Wang, Shenzhen (CN)

(72) Inventors: Shun Guo, Shenzhen (CN); Lubin Mao, Shenzhen (CN); Hongxing Wang, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 15/062,126

(22) Filed: Mar. 6, 2016

(65) Prior Publication Data

US 2017/0034630 A1 Feb. 2, 2017

(30) Foreign Application Priority Data

Jul. 31, 2015 (CN) ..... 2015 2 0571809 U

(51) Int. Cl.
*H04R 7/20* (2006.01)
*H04R 9/04* (2006.01)
*H04R 9/06* (2006.01)

(52) U.S. Cl.
CPC ..... *H04R 7/20* (2013.01); *H04R 9/045* (2013.01); *H04R 9/06* (2013.01); *H04R 2499/11* (2013.01)

(58) Field of Classification Search
CPC ..... H04R 7/20; H04R 2307/207
See application file for complete search history.

(56) References Cited

U.S. PATENT DOCUMENTS 6,259,800 B1 * 7/2001 Tagami ..... H04R 9/06 381/398
2003/0096632 A1 * 5/2003 Kim ..... H04M 1/035 455/550.1
2016/0118032 A1 * 4/2016 Kawka ..... G10K 11/002 181/171

* cited by examiner

*Primary Examiner* — Matthew Eason
(74) *Attorney, Agent, or Firm* — Na Xu; IPro, PLLC

(57) ABSTRACT

A long stroke speaker is provided in the present disclosure. The long stroke speaker includes a shell, a magnetic system received in the shell, and a vibrating system. The vibrating system includes a membrane and a coil assembly connecting to the membrane for driving the membrane to vibrate. The membrane includes a membrane body and a periphery surrounding the membrane body. The periphery includes a first periphery part with a first protrusion portion protruding away from the magnetic system, and a second periphery part with a second protrusion portion protruding towards the magnetic system.

16 Claims, 7 Drawing Sheets

1

LONG STROKE SPEAKER

FIELD OF THE DISCLOSURE

The present disclosure relates to electro-acoustic converting technologies, and more particularly, to a long stroke speaker applicable to a mobile device for producing audible sound.

BACKGROUND

Speakers are widely applied in mobile devices, such as mobile phones, tablet computers, laptop computers, portable game player, portable multimedia devices, or the like, for converting electrical signals into audible sounds. The speakers can be categorized into long stroke speakers and short stroke speakers according to stroke lengths of voice coils in the speakers.

A related long stroke speaker includes a vibration system, a magnetic system, and a holder for holding the vibration system and the magnetic system. The vibrating system includes a membrane and a voice coil connected to the membrane for driving the membrane to vibrate and produce sound. The membrane may need to vibrate with a great vibration amplitude due to the long stroke of the voice coil, however, the membrane may merely endure a limited vibration amplitude in practice due to a single periphery configuration thereof. Moreover, the great vibration amplitude of the membrane may cause the vibrating system to suffer undesired swinging. Accordingly, an acoustic performance of the long stroke speaker is low.

Therefore, it is desired to provide a new speaker which can overcome the aforesaid problems.

BRIEF DESCRIPTION OF THE DRAWINGS

Many aspects of the embodiment can be better understood with reference to the following drawings. The components in the drawing are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

The present disclosure will be described in detail below with reference to the attached drawings and the embodiment thereof.

Figure 1:
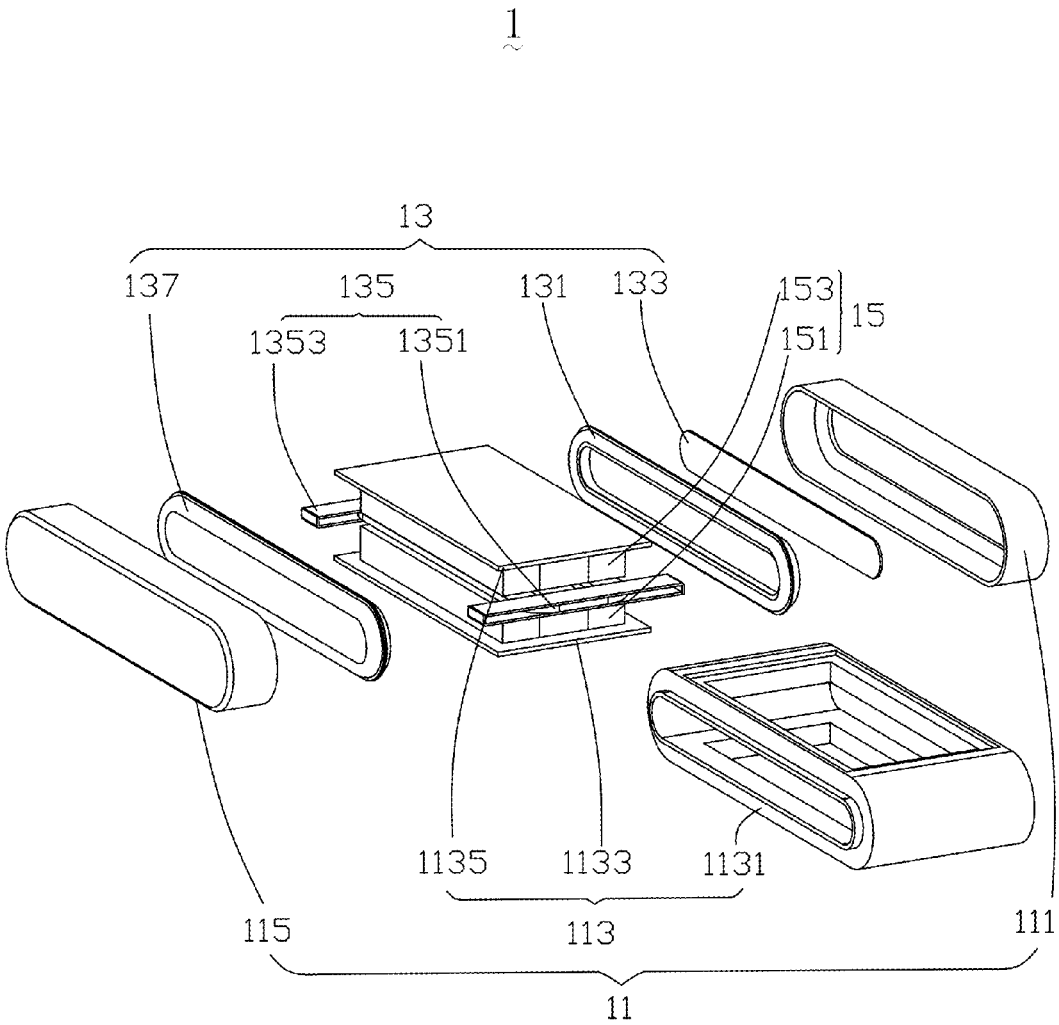
FIG. 1 is an exploded view of a long stake speaker according to a an embodiment of the present disclosure.
Figure 2:
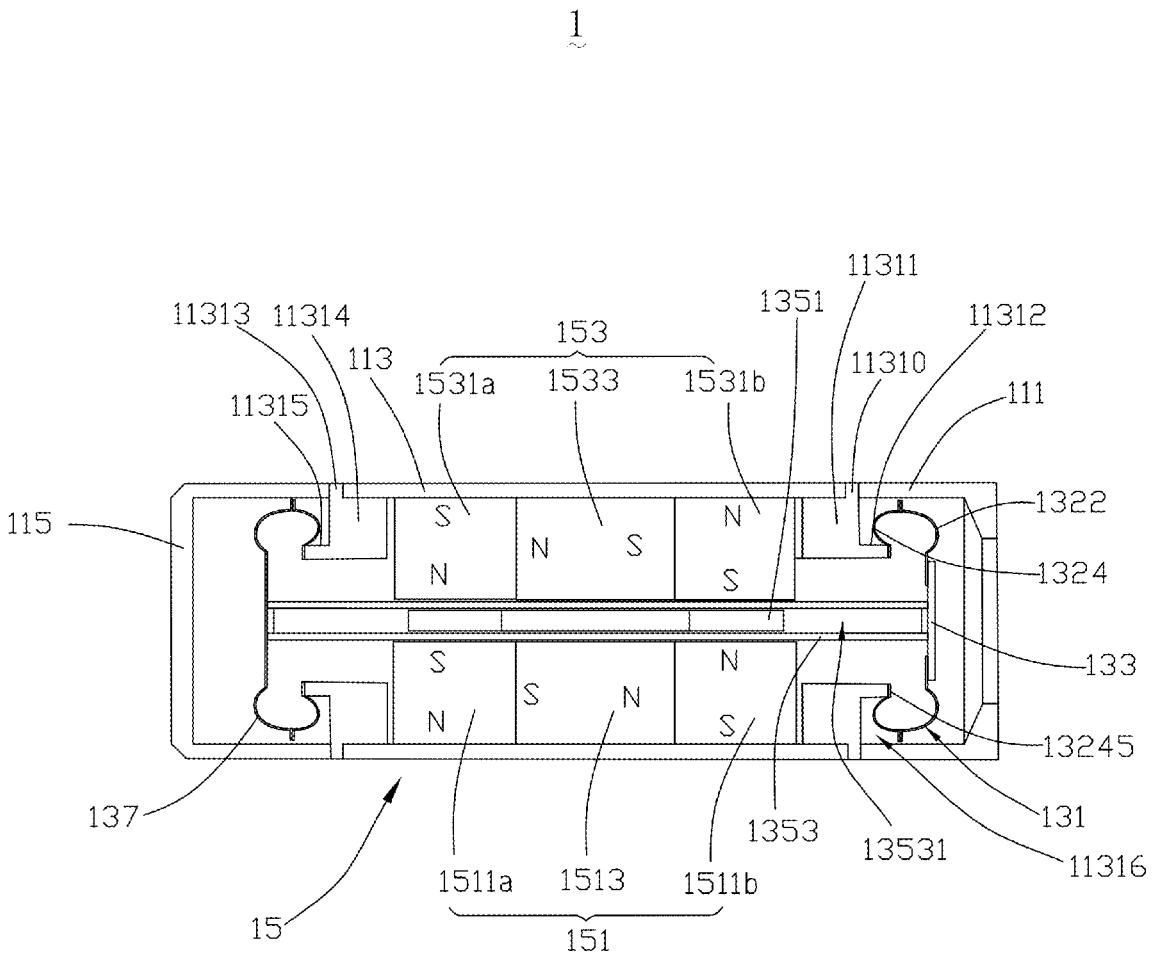
FIG. 2 is a cross-sectional view of the long stroke speaker of FIG. 1.

Referring to FIGS. 1-2, a long stroke speaker 1 according to an embodiment of the present disclosure is shown. The long stroke speaker 1 includes a shell 11, a vibrating system 13 and a magnetic system 15. The shell 11 provides an accommodating space; the vibrating system 13 and the magnetic system 15 are accommodated in the accommodating space.

The shell 11 includes a front cover 111, a rear cover 115 and a shell body 113. The front cover 111 opens towards a front end of the shell body 113, and may include an opening formed opposite to the shell body 113. The opening serves as a sound outlet of the long stroke speaker 1. The rear cover 115 opens towards a rear end of the shell body 115. The front cover 111 and the rear cover 115 respectively cover the front end and the rear end of the shell body 113 to form the accommodating space.

Figure 3:
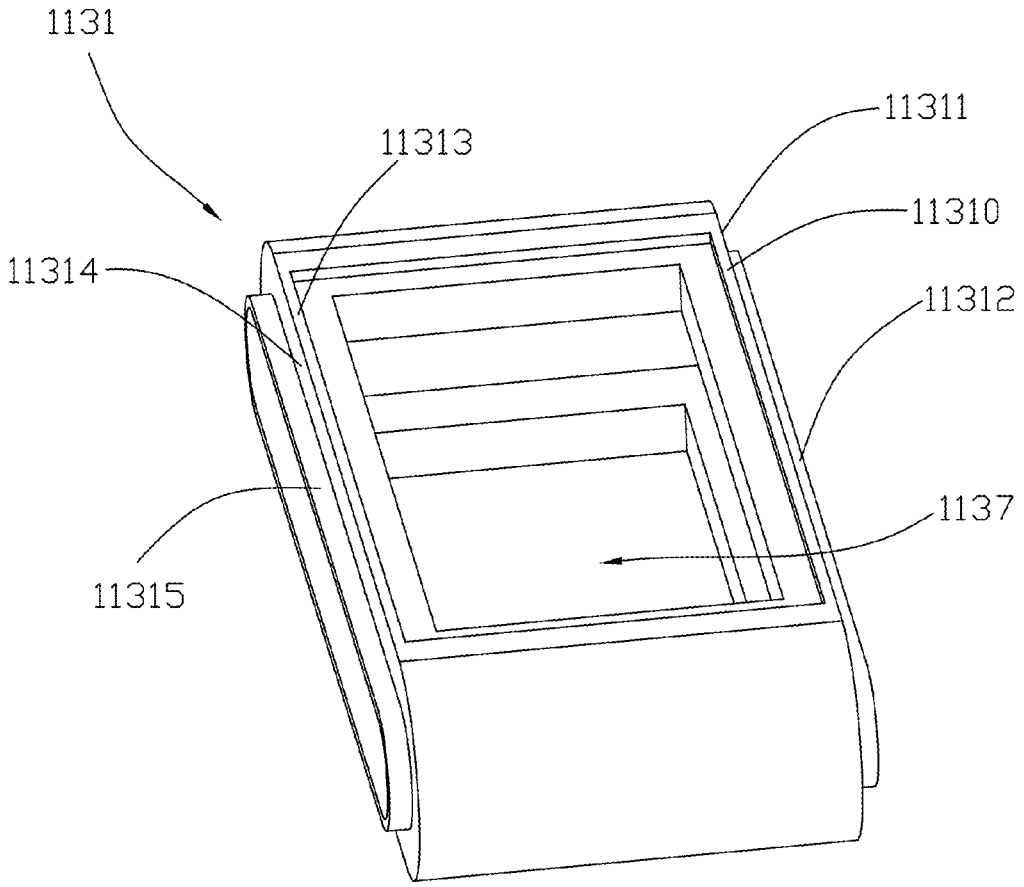
FIG. 3 is a schematic view of a main frame of the long stroke speaker of FIG. 1.

Referring also to FIG. 1 and FIG. 3, the shell body 113 includes a main frame 1131, a first cover plate 1133 and a second cover plate 1135. The main frame 1131 is a hollow frame with a receiving cavity 1137 for receiving the magnetic system 15, the receiving cavity 1137 may include a top opening and a bottom opening opposite to each other. The first cover plate 1133 and the second cover plate 1135 are respectively provided to cover the bottom opening and the top opening of the receiving cavity 1137. In the present embodiment, the first cover plate 1133 and the second cover plate 1135 are detachable from the main frame 1131, which is convenient for assembly and disassembly of speaker components (including the vibrating system 13 and the magnetic system 15) inside the shell 11.

The main frame 1131 includes a first sidewall 11311 adjacent to the front cover 111 and a second sidewall 11314 adjacent to the rear cover 115. The first sidewall 11311 includes a first engaging part 11310 protruding from an outer edge thereof in a vertical direction for engaging with the front cover 111, and a first extending part 11312 extending from an inner edge thereof in a horizontal direction and towards the front cover 111. The second sidewall 11314 includes a second engaging part 11313 protruding vertically from an outer edge thereof for engaging with the rear cover 115, and a second extending part 11315 extending horizontally from an inner edge thereof and towards the rear cover 115. In the present embodiment, the horizontal direction is parallel to a vibration direction of the vibrating system 13, and the vertical direction is perpendicular to the vibration direction of the vibrating system 13.

The vibrating system 13 includes a membrane 131, a dome 133, a coil assembly 135 and a supporting assembly 137. The membrane 131 is located in the front cover 111 and is connected to the first extending part 11312 of the main frame 1131; the supporting assembly 137 is located in the rear cover 115 and is connected to the second extending part 11315 of the main frame 1131. With the above-mentioned configuration, the receiving cavity 1137 of the main frame 1131 serves as a hermetical cavity, which can not only protect the speaker components therein, but also improve sound effect of the long stroke speaker 1. Moreover, the dome 133 is formed on the membrane 131 and faces the sound outlet of the long stroke speaker 100, and is configured for enhancing an intensity of the membrane and enabling the long stroke speaker 1 to have a better sound effect.

Figure 4:
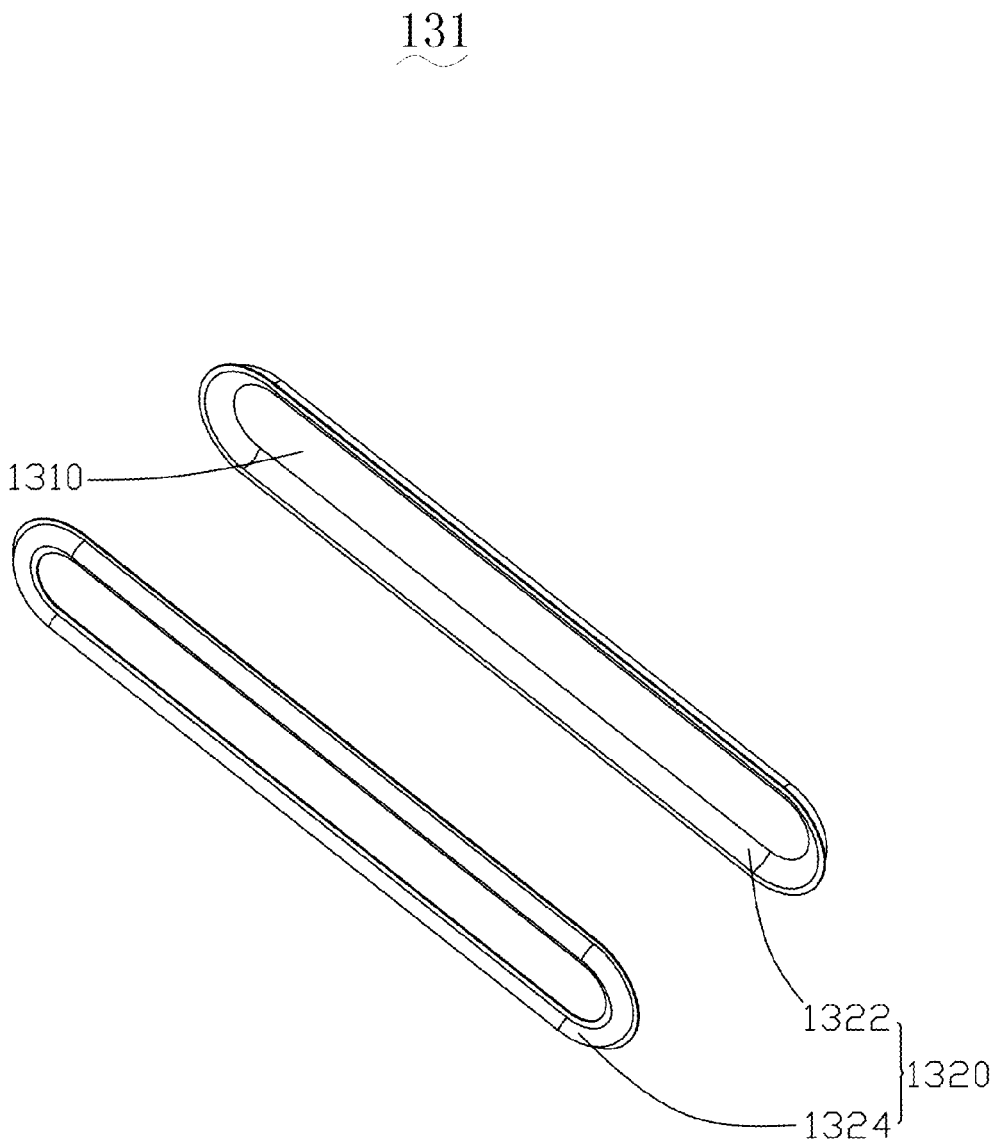
FIG. 4 is an exploded view of a membrane of the long stroke speaker of FIG. 1.
Figure 5:
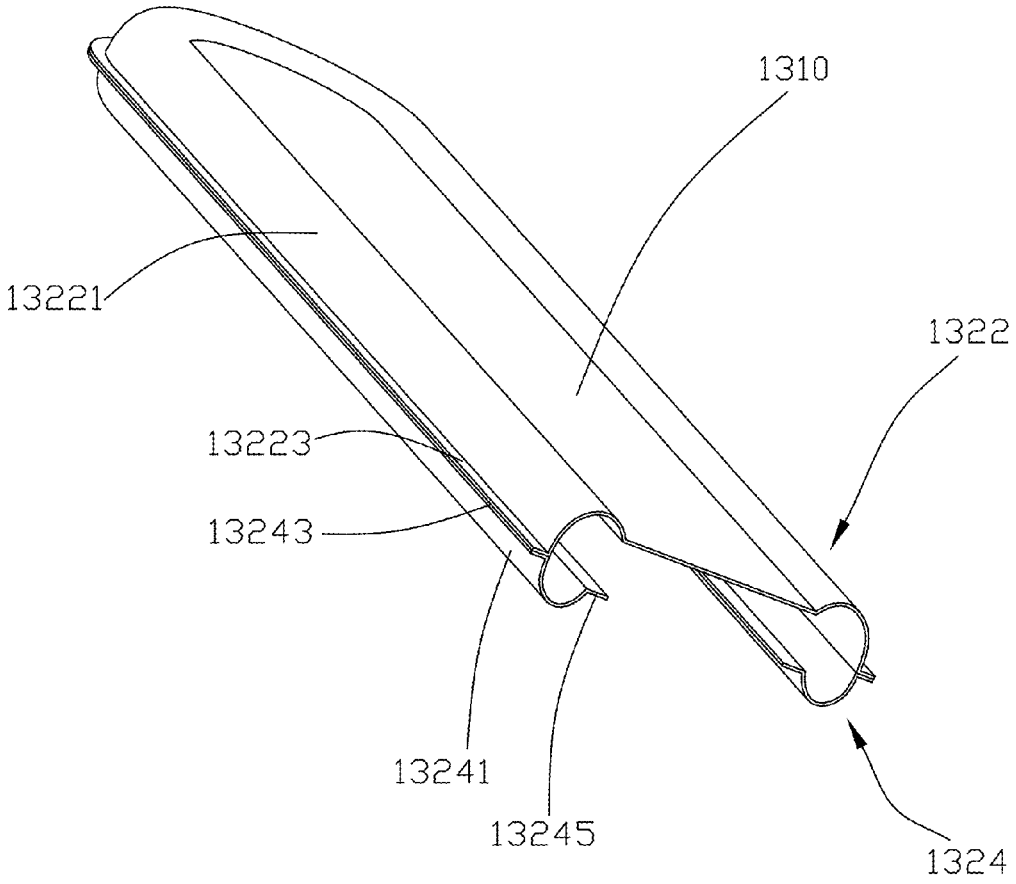
FIG. 5 is an assembled view of the membrane of FIG.4.

Referring also to FIGS. 4-5, the membrane 131 includes a membrane body 1310 at a main central region thereof, and a periphery 1320 surrounding the membrane body 1310. The periphery 1320 includes a first periphery part 1322 and a second periphery part 1324.

The membrane body 1310 may have a rectangular shape. The first periphery part 1322 includes a ring-shaped first protrusion portion 13221 surrounding the membrane body 1310, and a first fixing portion 13223 extending outwards from the first protrusion portion 13221. The first protrusion portion 13221 extends from an outer edge of the membrane body 1310 and protrudes away from the magnetic system 15; in the present embodiment, the first protrusion portion 13221 has a curved profile. The first fixing portion 13223 and the membrane body 1310 are respectively located at two opposite sides of the first protrusion portion 13221.

The second periphery part 1324 is arranged opposite to the first periphery part 1322, and includes a ring-shaped second protrusion portion 13241, a second fixing portion 13243 and a third fixing portion 13245. The second protrusion portion 13241 protrudes opposite to the first protrusion portion 13221; in other words, the second protrusion portion 13241 protrudes towards the magnetic system 15. The second fixing portion 13243 and the third fixing portion 13245 extend respectively from two opposite ends of the second protrusion portion 13241. The second fixing portion 13243 has a configuration substantially same as that of the first fixing part 13223, and is fixed to the first fixing portion 13243 by adhering or other fixing approach; the third fixing portion 13245 may be fixedly connected to the first extending part 11312 of the main frame 1131, and consequently, the second protrusion part 13241 is received in a receiving recess 11316 cooperatively formed by the front cover 111, the first sidewall 11311 and the first extending part 11312 thereof.

Moreover, in the present embodiment, the membrane body 1310, the first fixing portion 13223, the second fixing portion 13243 and the third fixing portion 13245 may be parallel to each other and is perpendicular to the vibration direction of the vibrating system 13. In addition, the second protrusion portion 13241 has a curved profile as the first protrusion portion 13221 but with different curvature; for example, the second protrusion portion 13241 may have a curvature greater than that of the first protrusion portion 13221.

Figure 6:
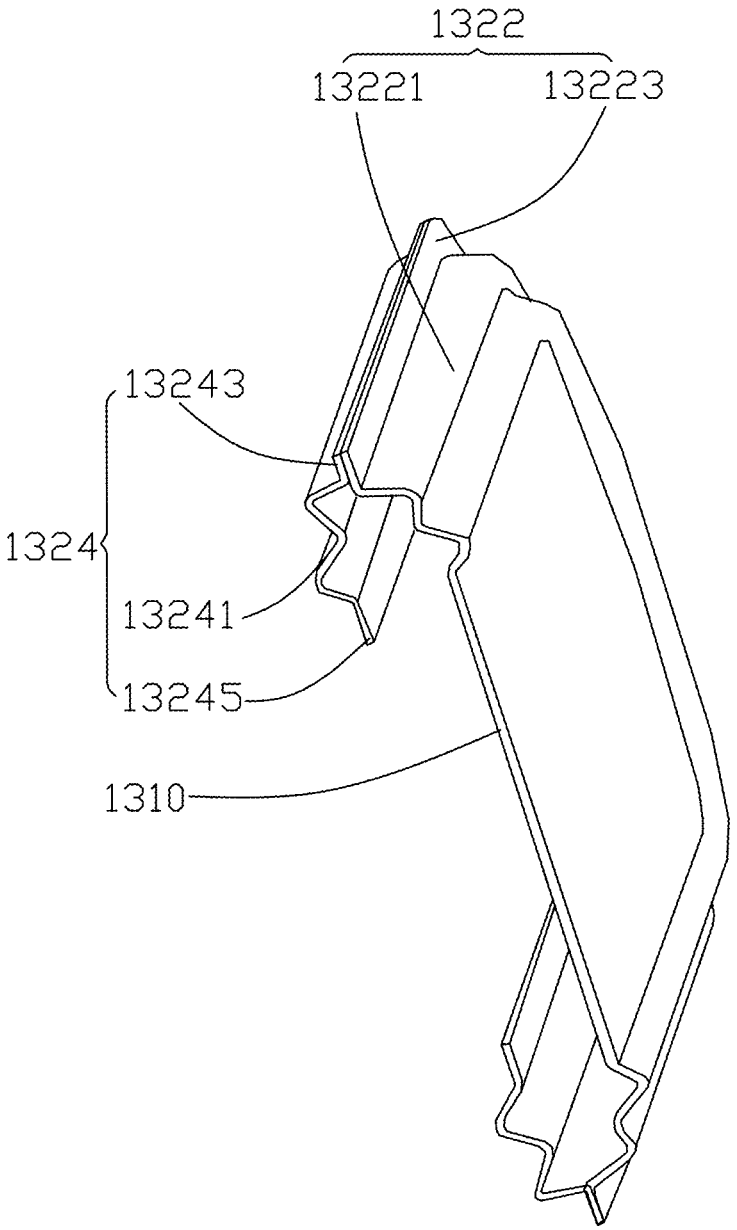
FIG. 6 is a schematic view of an alternative membrane applicable to the long stroke speaker of FIG. 1.

Alternatively, in other embodiments, both the first protrusion portion 13221 and the second protrusion portion 13241 may have profiles with other shapes. For example, in an alternative embodiment as illustrated in FIG. 6, both the first protrusion portion 13221 and the second protrusion portion 13241 may have a W-shaped or wavy profile, which can expand a surface area of the membrane 131 and thereby increase an endurable amplitude of the membrane 131.

The supporting assembly 137 may have a configuration similar to that of the membrane 131, and is arranged substantially symmetrical with the membrane 131 about the coil assembly 135. Specifically, the supporting assembly 137 includes a main plate corresponding to a membrane body 1310, and two opposite periphery parts corresponding to the first periphery part 1322 and the second periphery part 1324 respectively. One of the periphery parts surrounds the main plate and the other one of the periphery parts is connected to the second extending part 11315.

Figure 7:
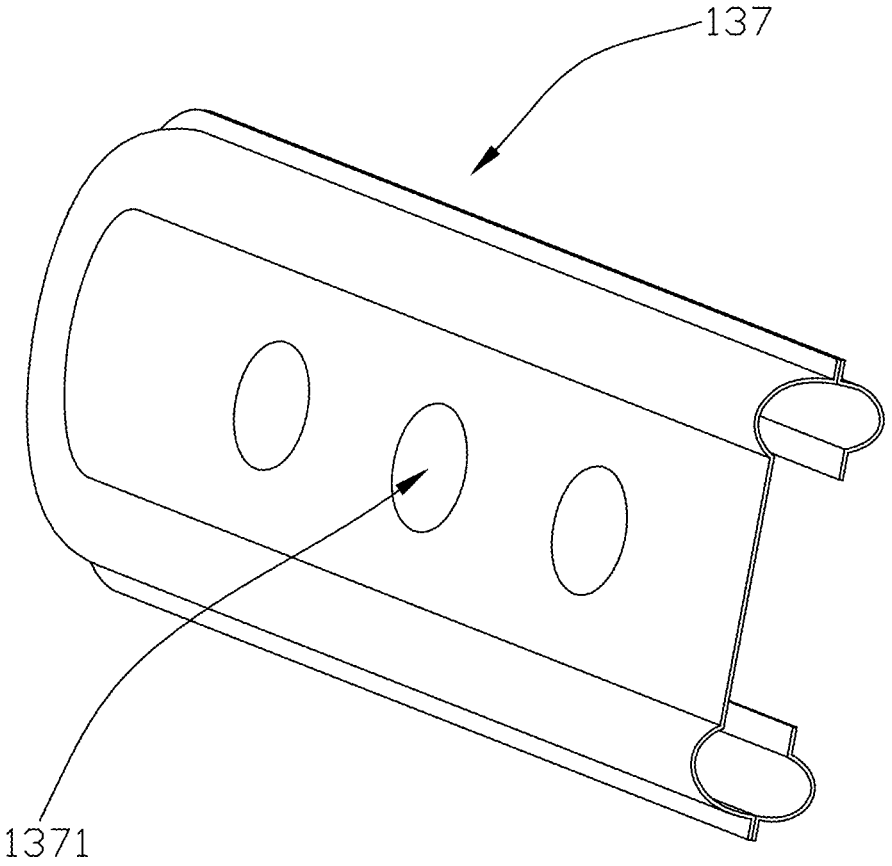
FIG. 7 is a schematic view of a supporting assembly of the long stroke speaker of FIG. 1.

Referring also to FIG. 7, the supporting assembly 137 differs from the membrane 131 in that the main plate of the supporting assembly 137 includes a plurality of air holes 1371; the air holes 1371 may be arranged in a line at a central region of the main plate, and are communicated with the receiving cavity 1137. Due to the air holes 1371, the supporting assembly 137 does not produce sound, however, the supporting assembly 137 can prevent the coil assembly 135 and the membrane 131 from suffering undesired swinging and increase K-value of the long stroke speaker 1, so that the long stroke speaker 1 has better sound effect as well as a longer lifespan.

The coil assembly 135 includes a coil 1351 located at a magnetic gap provided by the magnetic system 13, and a coil support 1353 for supporting the coil 1351 and transferring motion of the coil 1351 to the membrane 131. The coil 1351 may be an oblate ring-shaped coil, which can be positioned in the magnetic gap to obtain a long stroke. The coil support 1353 is connected between the membrane 131 and the supporting assembly 137; in particular, two opposite ends of the coil support 1353 may abut against the membrane body 1310 and the main plate of the supporting assembly 137. The coil support 1353 includes a pair of connecting members opposite to each other for forming a receiving gap 13531, and the coil 1351 is received in the receiving gap 13531 between the connecting members.

The magnetic system 15 includes a first magnet module 151 and a second magnet module 152 opposite to and apart from each other to form the magnetic gap. The first magnet module 151 includes a first main magnet 1511*a*, a second main magnet 1511*b*, and a first secondary magnet 1513 arranged between the first main magnet 1511*a* and the second main magnet 1511*b*. The first main magnet 1511*a*, the second main magnet 1511*b* and the first secondary magnet 1513 are all elongated permanent magnets; the first main magnet 1511*a* and the second main magnet 1511*b* are parallel to each other but have opposite magnetized directions, and a magnetized direction of the first secondary magnet 1513 is perpendicular to that of the first main magnet 1511*a* and the second main magnet 1511*b*.

The second magnet module 153 includes a third main magnet 1531*a*, a fourth main magnet 1531*b*, and a second secondary magnet 1533 arranged between the third main magnet 1531*a* and the fourth main magnet 1531*b*. The third main magnet 1531*a*, the fourth main magnet 1531*b* and the second secondary magnet 1533 are all elongated permanent magnets; the third main magnet 1531*a* and the fourth main magnet 1531*b* are parallel to each other but have opposite magnetized directions, and a magnetized direction of the second secondary magnet 1533 is perpendicular to that of the third main magnet 1531*a* and the fourth main magnet 1531*b*.

Furthermore, the first main magnet 1511*a*, the second main magnet 1511*b* and the first secondary magnet 1513 are opposite to the third main magnet 1531*a*, the fourth main magnet 1531*b* and the second secondary magnet 1533 respectively. A magnetized direction of the first main magnet 1511*a* is same as that of the third main magnet 1531*a*, and a magnetized direction of the second main magnet 1511*b* is same as that of the fourth main magnet 1531*b*, however, a magnetized direction of the first secondary magnet 1513 is opposite to that of the second secondary magnet 1533.

For example, as illustrated in FIG. 2, the first main magnet 1511*a* and the third main magnet 1531*a* are arranged at two opposite sides of the coil assembly 135 along the vertical direction, in such a manner that an S-pole end of the first main magnet 1511*a* and an N-pole end of the third main magnet 1531*a* face the coil assembly 135, while an N-pole end of the first main magnet 1511*a* and the an S-pole end of the third main magnet 1531*a* are respectively adjacent to the first cover plate 1133 and the second cover plate 1135. Similarly, the second main magnet 1511*b* and the fourth main magnet 1531*b* are also arranged at two opposite sides of the coil assembly 135 along the vertical direction, but in such a manner that an N-pole end of the second main magnet 1511*b* and the an S-pole end of the fourth main magnet 1531*b* face the coil assembly 135, while an S-pole end of the second main magnet 1511*b* and an N-pole end of the fourth magnet 1531*b* are respectively adjacent to the first cover plate 1133 and the second cover plate 1135.

In addition, the first secondary magnet 1513 and the second secondary magnet 1533 are arranged at two opposite sides of the coil assembly 135. An S-pole end of the first secondary magnet 1513 is adjacent to the first main magnet 1511*a*, while an N-pole end of the first secondary magnet 1513 is adjacent to the second main magnet 1511*b*. An N-pole end of the second secondary magnet 1533 is adjacent to the third main magnet 1531*a*, while an S-pole end of the second secondary magnet 1533 is adjacent to the fourth main magnet 1531*b*.

In summary, the long stroke speaker 1 as provided in the present disclosure uses the membrane 131 with two opposite periphery parts, therefore, the membrane 131 can endure a relatively great vibration amplitude; moreover, the supporting assembly 137 used in the long stroke speaker 1 can prevent the coil assembly 135 and the membrane 131 from suffering undesired swinging. As such, an acoustic performance of the long stroke speaker 1 is improved.

It should be noted that the above description is merely one of optional configurations of the magnetic system 13, in other embodiments, for example, each of the first magnet module 151 and the second magnet module 153 may only include a single main magnet, alternatively, the second magnet module 153 may be removed or replaced by a magnetic-conductive component.

It is to be understood, however, that even though numerous characteristics and advantages of the present embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A long stroke speaker, comprising:

a shell;

a magnetic system received in the shell; and a vibrating system comprising a membrane and a coil assembly connecting to the membrane for driving the membrane to vibrate;

wherein the membrane comprises a membrane body and a periphery surrounding the membrane body, the periphery comprises a first periphery part with a first protrusion portion protruding away from the magnetic system, and a second periphery part with a second protrusion portion protruding towards the magnetic system, the shell comprises a front cover, a rear cover and a main frame, the front cover and the rear cover respective cover a front end and a rear end of the main frame, and the main frame provides a receiving cavity for receiving the magnetic system, the main frame comprises a first sidewall with a first engaging part for engaging with the front cover, and a second sidewall with a second engaging part for engaging with the rear cover.

2. The long stroke speaker of claim 1, wherein both the first protrusion portion and the second protrusion portion have a curved profile.

3. The long stroke speaker of claim 2, wherein the second protrusion portion has a curvature greater than that of the first protrusion portion.

4. The long stroke speaker of claim 1, wherein each of the first protrusion portion and the second protrusion portion has a W-shaped profile or a wavy profile.

5. The long stroke speaker of claim 1, wherein the first protrusion portion surrounds the membrane body, and the first periphery part further comprises a first fixing portion extending outwards from the first protrusion portion.

6. The long stroke speaker of claim 5, wherein the second protrusion portion is opposite to the first protrusion portion, and the second periphery part further comprises a second fixing portion extending from the second protrusion portion, the second fixing portion is fixed to the first fixing portion of the first periphery part.

7. The long stroke speaker of claim 1, wherein the main frame comprises a top opening and a bottom opening; the shell further comprises a first cover plate and a second cover plate covering the bottom opening and the top opening respectively.

8. The long stroke speaker of claim 1, wherein the first sidewall comprises a first extending part extending towards the front cover, and the second sidewall comprises a second extending part extending towards the rear cover.

9. The long stroke speaker of claim 8, wherein the second periphery part of the membrane further comprises a third fixing portion extending opposite to the second fixing portion, the third fixing potion is fixed to the first extending part of the main frame.

10. The long stroke speaker of claim 9, wherein the vibrating system further comprises a supporting assembly, the supporting assembly and the membrane are respectively connected at two opposite ends of the coil assembly.

11. The long stroke speaker of claim 10, wherein the supporting assembly comprises a main plate and two opposite periphery parts, one of the periphery parts of the supporting assembly surrounds the main plate and protrudes away from the magnetic system, and the other one of the periphery parts of the supporting assembly protrudes towards the magnetic system is connected to the second extending part of the main frame.

12. The long stroke speaker of claim 11, wherein the main plate of the supporting assembly comprises a plurality of air holes communicated with the receiving cavity of the main frame.

13. The long stroke speaker of claim 11, wherein the coil assembly comprises a coil and a coil support for supporting the coil, a first end of the coil support is connected to the membrane and abuts against the membrane body of the membrane, a second end of the coil support is connected to the supporting assembly and abuts against the main plate of the supporting assembly.

14. The long stroke speaker of claim 13, wherein the coil support comprises a pair of connecting members opposite to each other for forming a receiving gap, and the coil is received in the receiving gap between the connecting members.

15. The long stroke speaker of claim 14, wherein the vibrating system further comprises a dome arranged on the membrane body, the dome and the coil support are respectively arranged at two opposite sides of the membrane body.

16. The long stroke speaker of claim 1, wherein the magnetic system comprises a first magnet module and a second magnet module opposite to each other for forming a magnetic gap, and the coil is received in the magnetic gap.

* * * * *